United States Patent [19]

Smith et al.

[11] 3,946,396

[45] Mar. 23, 1976

[54] ANTENNA FOR PROVIDING A DIELECTRICALLY INDUCED, DIRECTIONALLY DEPENDENT RADIATION PATTERN PHASE SHIFT

[75] Inventors: Valor C. Smith, La Mesa; Marvin Gantsweg, Tarzana, both of Calif.; Ivan M. Faigen, Cochituate, Mass.

[73] Assignee: The Magnavox Company, Fort Wayne, Ind.

[22] Filed: Mar. 6, 1974

[21] Appl. No.: 448,588

[52] U.S. Cl. ..... 343/753; 343/102; 343/891

[51] Int. Cl.[2] ..... H01Q 19/06

[58] Field of Search ..... 343/753, 754, 755, 854, 343/911 R, 102

[56] References Cited

UNITED STATES PATENTS

| | | | |
|---|---|---|---|
| 2,404,196 | 7/1946 | Seeley | 343/731 |
| 2,413,085 | 12/1946 | Tiley | 343/754 |
| 2,599,896 | 6/1952 | Clark et al. | 343/753 |
| 2,677,766 | 5/1954 | Litchford | 343/754 |
| 3,246,332 | 4/1966 | Waldman et al. | 343/754 |
| 3,434,142 | 3/1969 | Andre et al. | 343/854 |

*Primary Examiner*—Eli Lieberman

*Attorney, Agent, or Firm*—Thomas A. Briody; Joe E. Barbee; William J. Streeter

[57] ABSTRACT

An antenna for providing a radiation pattern in which the phase of the emitted electromagnetic waves varies with direction from the antenna. The emitted electromagnetic waves propagate through a region, associated with the antenna, having dielectric properties which are a function of the direction of propagation. The varying dielectric properties result in a direction-dependent phase shift for the emitted electromagnetic waves. By providing a reference radiation pattern having a phase-shift independent of direction, the direction from the antenna can be determined by comparison of the phases of the reference and of the direction-dependent electromagnetic waves.

6 Claims, 7 Drawing Figures

PRIOR ART

ANTENNA FOR PROVIDING A DIELECTRICALLY INDUCED, DIRECTIONALLY DEPENDENT RADIATION PATTERN PHASE SHIFT

BACKGROUND OF THE INVENTION

1. Field Of the Invention

This invention relates generally to antennas and more particularly to antennas used in providing direction-dependent radiation patterns. Direction-dependent radiation patterns are used in radar and navigation systems to localize the position of an object relative to the antenna.

2. Description Of the Prior Art

In order to provide a directional radiation pattern, it is known in the prior art to rotate mechanically an antenna emitting a relatively narrow radiation pattern. The radiation pattern thus emitted is a function of the direction of the antenna. The antenna can be rotated periodically thereby producing a radiation pattern in which the direction of the radiation pattern is a function of time. The use of mechanical apparatus to rotate an antenna is costly and requires periodic maintenance, frequently in a relatively inaccessible location.

It is also known in the prior art that an antenna, providing an omnidirectional azimuth-dependent radiation pattern, can be mechanically rotated to produce a radiation pattern in which the amplitude of the radiation pattern in a predetermined direction is a function of time. However, the problems associated with mechanical rotation, described above, as well as the difficulty in the determination of radiation pattern maxima or minima provide an undesirable limitation in the usefulness of this type of antenna.

To avoid problems associated with mechanical rotation of antennas, arrays of antenna elements have been used in the prior art to produce a directional radiation pattern. By varying the phase of the signals driving the antenna elements, the directional radiation pattern can be rotated as a function of time. However, the resolution of the array is severely limited without a large number of individual antenna elements. In addition, the application of appropriate driving signals to the array of antenna elements requires complex electronic equipment.

It is therefore an object of the present invention to provide an improved antenna.

It is another object of the present invention to provide an omnidirectional radiation pattern for determination of accurate position information.

It is still another object of the present invention to provide an omnidirectional radiation pattern for determination of object position information without mechanically moving parts.

It is yet another object of the present invention to provide an omnidirectional radiation pattern in which the phase of the emitted electromagnetic waves are a funtion of the direction from the emitting apparatus.

It is a further object of the present invention to provide an antenna emitting electromagnetic waves having a direction-dependent phase-shift.

It is a more particular object of the present invention to provide an antenna system having a radiation from which the position of an object relative to the antenna system can be determined.

It is another more particular object of the present invention to provide a direction-dependent radiation pattern by introducing into an antenna system dielectric materials whose properties vary as a function of the direction of the emitted electromagnetic waves.

SUMMARY OF THE INVENTION

The aforementioned and other objects of the present invention are accomplished by providing an antenna with a dielectric material through which emitted electromagnetic waves propagate. The dielectric material alters a velocity of electromagnetic waves propagating therethrough. By varying the properties of the dielectric material as a function of direction, the retardation and therefore the phase of an electromagnetic wave varies as a function of direction relative to antenna. By further providing reference electromagnetic waves emitted by the antenna whose properties are direction-independent, a direction relative to the antenna can be determined by a comparison of the phases of the direction-independent and direction-dependent electromagnetic waves.

These and other features of the invention will be understood upon reading of the following description along with the drawings.

BRIEF DESCRIPTION OF THE FIGURES

FIG. 1A is a top cross-sectional view of a directionally-symmetrical parallel plate antenna according to the prior art, while

FIG. 2A is a top cross-sectional view of a symmetrical parallel plate antenna to which dielectric material, according to the present invention, has been added, while

DESCRIPTION OF THE PREFERRED EMBODIMENT

Figure 1A:
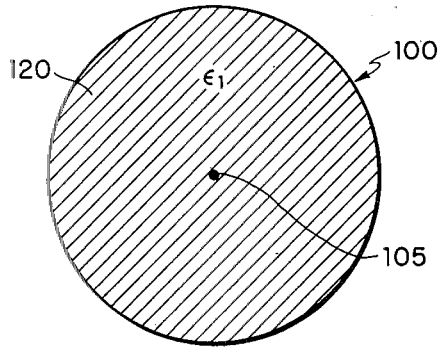
FIG. 1A PRIOR ART
Figure 1B:
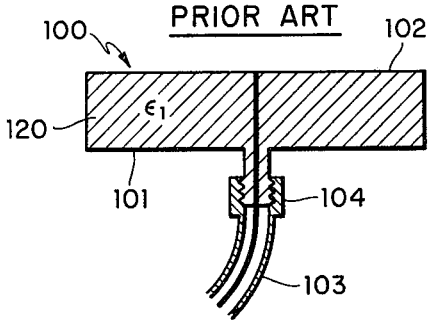
FIG. 1B is a side cross-sectional view of a directionally-symmetrical parallel plate antenna according to the prior art.

Referring now to FIG. 1A and FIG. 1B, top and side cross-sectional views, respectively, are shown for an antenna emitting axially-symmetric electromagnetic waves according to the prior art. A varying current flowing in Center Conductor 105 of Antenna 100 causes electromagnetic waves to propagate through Dielectric Region 120 contained between circular Conducting Plate 101 and a parallel circular Conducting Plate 102. After reaching the boundary of the Conduction Plates, the electromagnetic waves propagate through space. Because of the location of Center Conductor 105 on the axis of the parallel circular plates, the radiation pattern produced by the Antenna 100 is axially symmetric. The current in the Center Conductor 105 is driven by electrical signals introduced into Antenna 100 from a driving source (not shown) via Cable 103. Cable 103 is coupled to Antenna 100 via Coupler 104. Cable 103 is typically a coaxial cable, while Coupler 104 can be a standard coaxial cable coupling apparatus. The Dielectric Region 120, shown in FIG. 1A and FIG. 1B and having a dielectric constant, $\epsilon_1$, is typically air; however, other materials can be substituted (e.g. for mechanical support) as will be apparent to one skilled in the art.

Figure 2A:
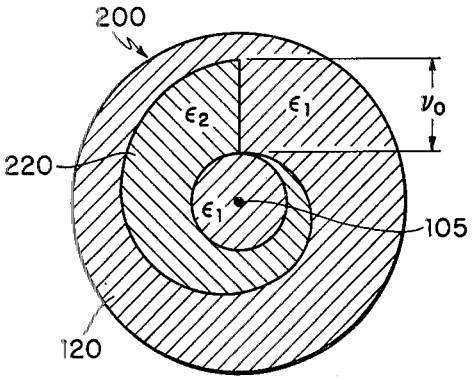
Figure 2B:
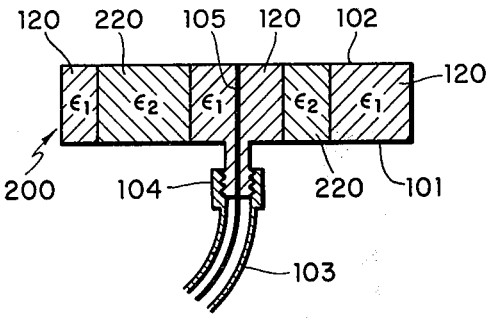
FIG. 2B is a side cross-sectional view of a symmetrical parallel plate antenna to which dielectric material, according to the present invention, has been added.

Referring next to FIG. 2A and FIG. 2B, top and side cross-sectional views, respectively, are shown for Antenna 200 providing a radiation pattern in which a phase shift of emitted electromagnetic waves is a function of direction. Electrical signals are introduced in Antenna 200 via Cable 103 and Coupler 104 and produce a varying current in Center Conductor 105. Electromagnetic Waves, generated by the varying current in the Center Conductor 105, are propagated radially between Circular Plate 101 and parallel Circular Plate 102. Center Conductor 105 is located at the axis of the Circular Plates.

The region between the parallel Circular Plates 101 and 102 is filled with materials having two dielectric constants. Dielectric Region 120 contains a material with a dielectric constant, $\epsilon_1$, while Dielectric Region 220 contains a material with a different dielectric constant, $\epsilon_2$. In the preferred embodiment, electromagnetic waves propagate at a lower velocity in a region containing material having a dielectric constant $\epsilon_2$ than in a region containing material having a dielectric constant $\epsilon_1$. In the preferred embodiment, the difference in the velocity of an electromagnetic wave of a preselected frequency will cause a retardation by a full wavelength (i.e. be shifted in phase by $-360°$) by travelling a distance $v_o$ in a material of dielectric constant $\epsilon_2$ as compared with the same electromagnetic wave travelling a distance of $v_o$ in a material of dielectric constant, $\epsilon_1$. Labelling the direction in which the region of dielectric constant $\epsilon_2$ is substantially zero as $\theta = 0°$, the thickness of Dielectric Region 220 encountered by an electromagnetic wave propagating in a radial direction from the center conductor at an angle $\theta$, is $v/360° \times \theta$ in the preferred embodiment. Thus the phase delay of the radially-propagating electromagnetic wave will be approximately a linear function of angle relative to the direction $\theta = 0°$.

Figure 3:
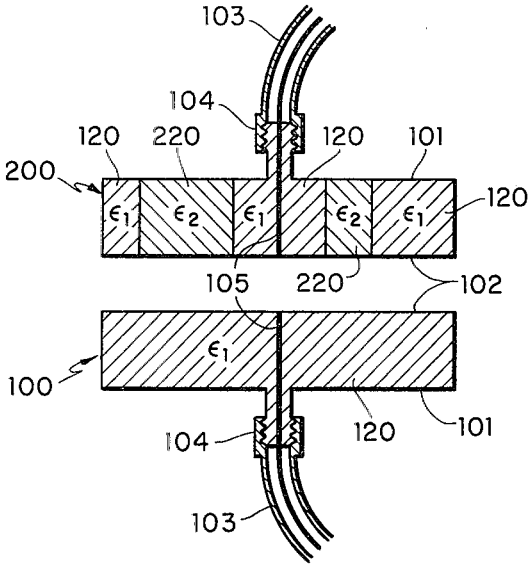
FIG. 3 is a side cross-sectional view of an antenna according to the present invention providing both a directionally-dependent and a directionally-independent radiation pattern.

Referring next to FIG. 3, an Antenna 100, according to the prior art, and an Antenna 200 of substantially the same geometry, according to the present invention are disposed parallelly along the same axis. The electromagnetic waves emitted radially in the direction in which the Dielectric Region 220 in Antenna 200 has substantially zero extent, will propagate in phase with the radiation for the same direction for Antenna 100. In all other directions, the radiation from Antenna 200 will have a phase delay relative to radiation in that direction from Antenna 100 approximately equal to the angular displacement from the radiation propagating in phase from the two antenna.

Figure 4:
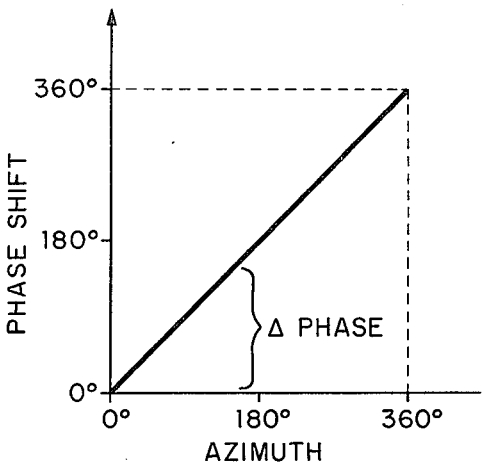
FIG. 4 is a plot of the variation of phase shift with azimuth angle for the antenna according to one embodiment of the present invention.

Thus, referring to FIG. 4, a determination of the difference $\Delta$ between the phase of the electromagnetic waves from Antenna 100 and the phase of the electromagnetic waves from Antenna 200 will specify the direction relative to the in-phase radiation, i.e. electromagnetic waves propagating a $\theta = 0°$. It will be apparent to one skilled in the art that to determine the sign of the direction relative to in-phase ratiation direction, identification must be made of the radiation from at least one of the antennas. In the preferred embodiment, a modulation signature is impressed radiation from both Antennas 100 and 200, to facilitate elctronic separation; however, other methods of radiation identification will be apparent to one skilled in the art.

Figure 5:
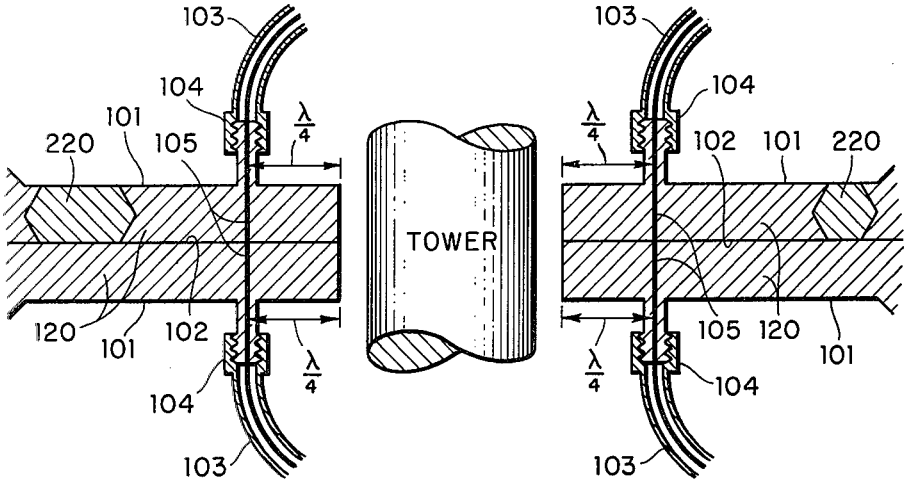
FIG. 5 is a side cross-sectional view of antenna for use on a tower providing a directionally-dependent and a directionally-independent radiation pattern.

Referring now to FIG. 5, the application of the present invention in a situation where the antenna is to be attached to a tower or mast is shown. To avoid a "shadow" from the mast, the antenna in this embodiment is comprised of a plurality of radiating sections, each section producing dielectrically phase-shifted electromagnetic waves and a non-phaseshifted electromagnetic waves. Each Center Conductor 105, providing the driving currently is placed $\pi/4$ wavelengths from a rear conducting wall to minimize the effects of electromagnetic reflections. Further, the electric signals introduced to each of Center Conductors 105 can all be in phase. The Dielectric Region 220 is arranged to vary with the direction of propagation.

As will be apparent to those skilled in the art, several variations utilizing the concepts of the preferred embodiment are possible. For example, the thickness $v_0$ of Dielectric Region 220 producing a retardation of one wavelength relative to Dielectric Region 120 need not be the maximum radial extent of Dielectric Region 220. If other values for the maximum radial extent of Dielectric Region 220 are used, a different value of angular displacement for the electromagnetic waves propagating in phase for a given phase difference $\Delta$, will be found. Further, the extent of the radial dimension of Dielectric Region 220 need not vary uniformly; however, more complicated calibration techniques are required for non-uniform variation. Further, Dielectric Regions 120 and 220 can be intermingled so that an "average" dielectric constant of a wave propagating radially is a function of angle. Finally, it will be apparent that departures from the disclosed axial symmetry of the antennas is possible while still utilizing a phase difference between electromagnetic radiation from two antennas to determine a direction relative to the antennas.

The foregoing description has included a continuously varying dielectric region. It will be apparent to those skilled in the art that changes in the dielectric region can be in incremental steps. In this embodiment, the number and magnitude of the discrete changes in the dielectric material provide a limitation on the resolution.

As will be apparent to one skilled in the art, the present invention can also be used in conjunction with standard ranging techniques, such as measuring the delay time between radiation emission and detection of effected radiation, to determine the distance of radiation-reflecting object from the antenna.

The above description is included to illustrate the operation of the preferred embodiment and is not meant to limit the scope of the invention. The scope of the invention is to be limited only by the following claims. From the above discussion, many variations are apparent to one skilled in the art which would yet be encompassed by the spirit and scope of the invention.

What is claimed is:

1. An omnidirectional, non-rotating antenna for providing a direction-dependent radiation pattern comprising:

means for emitting electromagnetic waves;

a region of dielectric material located in a propagation path of said means for emitting electromagnetic waves, wherein properties of said dielectrical region are a function of direction of said emitted electromagnetic waves relative to said antenna;

said emitting means produces omnidirectional electromagnetic waves;

said dielectric material region is disposed about said emitting means, said dielectric material region comprised of a dielectric material having uniform properties, a thickness of said uniform dielectric material is a function of angle relative to said emitting means thereby giving the omnidirectional waves a phase shift dependent on direction of the radiation pattern;

said thickness of said uniform dielectric material increases as a function of angle, said uniform dielectric material including a region of rapidly decreasing thickness; and said thickness of said uniform dielectric material corresponding to a difference between maximum thickness of said uniform dielectric material and a minimum thickness of said uniform dielectric thickness causes electromagnetic waves of a preselected frequency propagating therethrough to be retarded by substantially one wavelength.

2. An omnidirectional, non-rotating antenna for providing a direction-dependent radiation pattern comprising:

means for emitting electromagnetic waves;

a region of dielectric material located in a propagation path of said means for emitting electromagnetic waves, wherein properties of said dielectrical region are a function of direction of said emitted electromagnetic waves relative to said antenna; and a second radiation emitting means for providing a reference, said second radiation emitting means providing a uniform omnidirective radiation pattern of the same frequency as the means for emitting electromagnetic waves.

3. An omnidirectional antenna for emitting a direction-dependent radiation pattern comprising:

first means for generating electromagnetic waves;

a propagation region for guiding electromagnetic waves produced by said radiation-generating means;

a region of material having varying dielectric properties in said propagation region, said dielectric material region generally disposed about said radiation-generating means wherein said dielectric properties are a function of direction from said radiation-emitting element thereby providing a phase shift to the electromagnetic waves that are generated;

second means for generating omnidirectional electromagnetic waves to serve as a reference for said first means for generating electromagnetic waves; and a second propagation region for guiding electromagnetic waves provided by said second radiation-generating means.

4. An omnidirectional antenna system comprising:

a first axially-symmetric electromagnetic wave guide;

first means for producing electromagnetic radiation, said first radiation means producing first axially-symmetric electromagnetic waves;

a second axially-symmetric electromagnetic wave guide, an axis of symmetry of said second wave guide substantially identical with said symmetry axis of said first wave guide;

second means for producing electromagnetic radiation, said second radiation means producing second axially-symmetrical electromagnetic waves; and a region of dielectric material disposed about said second radiation means, said dielectric material region having dielectric properties varying as a function of angle about said axis of symmetry of said second radiation means, said dielectric material region causing a retardation of said second electromagnetic waves emitted from said second wave guide to be a function of angle thereby providing a phase shift that depends on angular direction of the electromagnetic radiation.

5. The antenna system of Claim 4 wherein said first wave guide and said second wave guide are comprised of a plurality of wave-guide elements, wherein said first wave guide and said second wave guide are disposed about an object located substantially along said symmetry axis.

6. An omnidirectional antenna providing an electromagnetic wave pattern that exhibits a phase shift related to direction of radiation from the antenna, comprising: a first omnidirectional emitting means to provide a direction-dependent phase shifted electromagnetic wave pattern; a second omnidirectional emitting means that emits a reference for the phase shifted electromagnetic wave; and a dielectric material surrounding the first omnidirectional emitting means so that as the electromagnetic wave propagates through the dielectric material it is retarded, thereby producing a phase shift, a different amount for each angular position of the emitting means.

* * * * *